US006666623B1

(12) United States Patent
Greene

(10) Patent No.: US 6,666,623 B1
(45) Date of Patent: Dec. 23, 2003

(54) BUOYANCY CONTROL DEVICE AND METHOD FOR CONTROLLING DIVERS ASCENT

(75) Inventor: Leonard M. Greene, White Plains, NY (US)

(73) Assignee: Safe Flight Instrument Corporation, White Plains, NY (US)

( * ) Notice: Subject to any disclaimer, the term of this patent is extended or adjusted under 35 U.S.C. 154(b) by 0 days.

(21) Appl. No.: 10/167,585

(22) Filed: Jun. 13, 2002

(51) Int. Cl.[7] ..... B63C 11/02

(52) U.S. Cl. ..... 405/186; 405/185; 441/88; 441/96

(58) Field of Search ..... 405/185, 186; 114/315, 331; 441/80, 88, 92, 96, 106, 108

(56) References Cited

U.S. PATENT DOCUMENTS 4,051,846 A * 10/1977 McClure, III ..... 405/186
4,324,507 A * 4/1982 Harrah ..... 441/92
5,542,446 A * 8/1996 Rose ..... 137/81.2
5,560,738 A * 10/1996 Noel ..... 405/186
6,287,053 B1 * 9/2001 Garofalo et al. ..... 405/186
6,435,032 B1 * 8/2002 Holloway et al. ..... 73/713
2002/0127062 A1 * 9/2002 Biran et al. ..... 405/186

FOREIGN PATENT DOCUMENTS

GB 2246745 * 2/1992 ..... 441/88

* cited by examiner

*Primary Examiner*—Jong-Suk (James) Lee
(74) *Attorney, Agent, or Firm*—Dennison, Schultz & Dougherty

(57) ABSTRACT

A buoyancy control device includes a buoyancy compensator to be worn by a scuba diver, a compressed air tank, a depth or pressure gauge and a valve connecting the buoyancy compensator and compressed air tank for releasing air into and out of the buoyancy compensator. A microprocessor is connected to the depth gauge and the valve for controlling the amount of air in the buoyancy compensator in response to the depth of the diver. In addition, the microprocessor is programed for automatically controlling the rate of ascent of a diver under normal conditions and for a faster rate of ascent under emergency conditions. The device also includes an override function which allows a second diver to override the normal rate of ascent and to initiate the faster rate of ascent in an emergency.

8 Claims, 3 Drawing Sheets

BUOYANCY CONTROL DEVICE AND METHOD FOR CONTROLLING DIVERS ASCENT

FIELD OF THE INVENTION

This invention relates to a buoyancy control device for scuba divers and more particularly to a buoyancy control device for controlling the vertical motion of a scuba diver under normal and emergency conditions.

BACKGROUND FOR THE INVENTION

Buoyancy compensators for scuba divers are well known for use in controlling buoyancy while diving. Such compensators typically consists of a flexible air bladder and hand-activated pneumatic fill and release valves. In this manner, the buoyancy force acting on the diver is changed by adjusting the volume of air in the flexible bladder.

Such compensators generally require careful attention from a diver to attain and maintain neutral buoyancy, to safely descend, to safely ascend and to establish adequate positive buoyancy at the surface. The diver controls buoyancy by using the hand-activated air valves to add and release air to and from the buoyancy compensator. Such control is based on vertical motion changes, references to stationary objects or the use of a depth gauge.

Neutral buoyancy is achieved at a selected depth and must be adjusted as the depth of the dive changes. A deviation from neutral buoyancy also occurs due to changes in the hydrostatic pressure of the water which changes in depth as well as changes in the loss of weight as air from the compressed air tank is used.

An improved buoyancy compensator that reduces the scuba divers attention and exertion required for buoyancy control is disclosed in the U.S. Pat. No. 5,496,136 of Egan. As disclosed therein, a buoyancy compensator includes an electronic sensor/valve assembly and a flexible air bladder which automates and controls the vertical motion of a diver. A computer acquires pressure, temperature and air flow data to determine the diver's vertical motion and the amount of air in the bladder. The computer controls electronic fill and release valves to change the volume of air in the bladder. Algorithms are implemented by the computer to automate controlled vertical propulsion for ascending, descending, neutral buoyancy, maintenance and surface operation. Automated transitions are provided between modes of operation and for a timed safety stop during the ascent from the dive.

Another approach for an improved buoyancy compensator device is disclosed in the U.S. Pat. No. 5,560,738 of Noel. As disclosed therein, a depth sensitive diver safety system is utilized with an underwater breathing apparatus. The system includes a first automatic ascent control stage which initiates gradual regulated inflation of a personal flotation device from a pressurized air source when a user drops below a danger/low air level corresponding to a diver's depth. The system also includes a second automatic ascent control stage which is structured to initiate gradual, regulated inflation of the personal flotation device upon the diver's depth exceeding a pre-set depth level. The 5,560,738 patent is incorporated herein in its entirety by reference.

A more recent approach to buoyancy compensators is disclosed in the U.S. Pat. No. 5,746,543 of Leonard. The Leonard patent discloses a volume control module for controlling the buoyancy of a diver by controlling the volume of air in a buoyancy chamber of a buoyancy compensator. The Leonard device is used in conjunction with underwater equipment which is provided with an adjustable buoyancy chamber. The Leonard patent is also incorporated herein in its entirety by reference.

Notwithstanding the advances disclosed in the aforementioned patents, it is presently believed that there is a need and a commercial demand for an improved buoyancy control device. It is believed that there is a need for a device in accordance with the present invention that provides buoyancy control without excessive diver attention through all phases of the dive. In addition, the buoyancy control device in accordance with the present invention provides for automated compensation for changes in buoyancy of a scuba tank as the air is consumed by a diver.

A further advantage of the buoyancy control devices in accordance with the present invention is that they provide automatic vertical propulsion and vertical velocity control of a diver during the descent portion of the dive and also during the ascent portion of the dive. A still further advantage of the present device is the inclusion of a safety feature that allows a diver or a second diver to provide for a relatively fast ascent under an emergency with a limited risk of a lung expansion injury or decompression sickness.

Further, the improved device in accordance with the present invention allow a second diver to send an injured or unconscious diver to the surface unaccompanied by the second diver at a controlled rate. In addition, it is believed that the devices in accordance with the present invention can be manufactured at a competitive price, and are reliable and durable.

BRIEF SUMMARY OF THE INVENTION

In essence, the present invention contemplates an improved buoyancy control device for scuba divers. The device includes a buoyancy compensator or vest to be worn by or attached to a diver. The device also includes one or more compressed air tanks adapted to be carried by a diver in a conventional manner and means such as a depth or pressure gauge for measuring the depth of a diver. A valve or other means is connected to the buoyancy compensator and the compressed air tank for releasing air from the compressed air tank into the buoyancy compensator and for releasing air out of the buoyancy compensator. The device also includes a microprocessor operatively connected to the means for measuring the depth of the diver and to the valve for controlling the amount of air in the buoyancy compensator in response to the depth of a diver. In addition, the device includes means for inputting a first selected rate of ascent for controlling the vertical movement of a diver under normal conditions and a second selected rate of ascent for controlling the vertical movement of a diver under emergency conditions. An additional element in the device is means accessible by a second diver for overriding the first rate of ascent and activating the second rate of ascent. In this way, a disabled or unconscious diver can be safely sent to the surface without escort by a rescuing diver at a rate which is greater than normal but acceptable under emergency conditions.

The invention will now be described in connection with the accompanying drawings wherein like numbers are used to indicate like parts.

DETAILED DESCRIPTION OF THE PREFERRED EMBODIMENTS OF THE INVENTION

Figure 1:
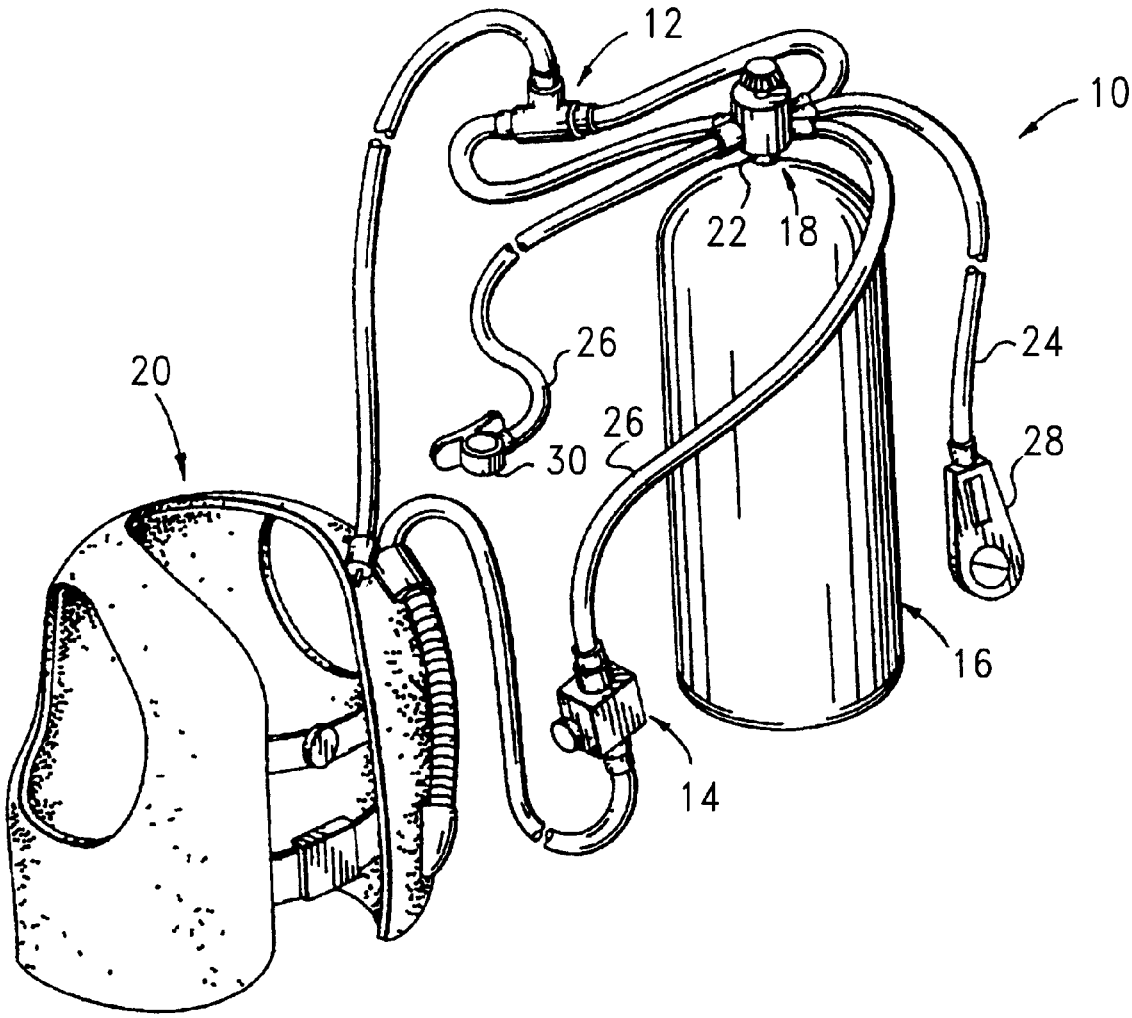
FIG.1 (PRIOR ART)
FIG. 1 is a perspective view of a prior art depth sensitive safety system of a type used in connection with scuba diving.

The buoyancy compensator device according to a preferred embodiment of the present invention is designed for use with conventional scuba diving equipment. For example, a depth sensitive diver safety system as disclosed in the aforementioned Noel patent is shown in FIG. 1. As shown therein, a scuba diving system 10 includes first and second automatic control stages 12 and 14. The system 10 also includes at least one pressurized air tank and possibly more which can be defined as a pressurized air source 16. A high-low pressure regulator 18 and a personal flotation device 20 such as a vest which is adapted to be worn or attached to a diver are also provided.

The conventional scuba diving system 10 typically includes an air outlet 22 connected to the high-low pressure regulator 18 to provide a source of air for various purposes. For example, the high-low pressure regulator 15 includes at least one high pressure air source 24 and one low pressure source 26. It is common for regulators 18 to include a high pressure source 24 connected with a plurality of gauges 28 which indicate the quantity of air remaining in the air source 16 and a plurality of low pressure sources 26 which lead to a second stage 30 through which the diver breathes and the personal flotation device 20 is connected to the source 16. The low pressure air source 26 is constructed and arranged so that air will be supplied at a breathable pressure which co-responds to a diver's depth. To be more specific, as a diver descends beneath the water surface, the breathable pressure which corresponds to the diver's depth will increase. Similarly, as the diver ascends to the surface, the breathable pressure will decrease. This same breathable pressure is the pressure at which the low pressure air source 26 which exits the regulator 18 are maintained.

As taught by the aforementioned Noel patent, a first ascent control stage 12 is constructed and arranged to initiate inflation of a personal flotation device 20 upon an air pressure within the air tank or pressurized air source 16 dropping to a dangerously low level with respect to a diver's depth. Further, as a diver descends beneath the water surface, he/she will require greater quantities of air to safely return to the water surface. Additionally, at greater depths, the pressure is greater such that air will be drawn from the pressurized air source 16 at a much more rapid rate which necessitates additional air for the diver to return to the surface.

In addition, the device in accordance with the U.S. Pat. No. 5,560,738 includes a second automatic ascent control stage 14. The second ascent control stage 14 is constructed and arranged to initiate gradual regulated inflation of a personal flotation device 20 when the diver's depth exceeds a pre-set safe depth level. The second automatic ascent control stage 14 is connected in line with the low pressure air source 16 either integrally or separately from the first automatic control stage 12 and can alternatively be connected at and/or replace the conventional inflator connections of a personal flotation device 20.

Figure 2:
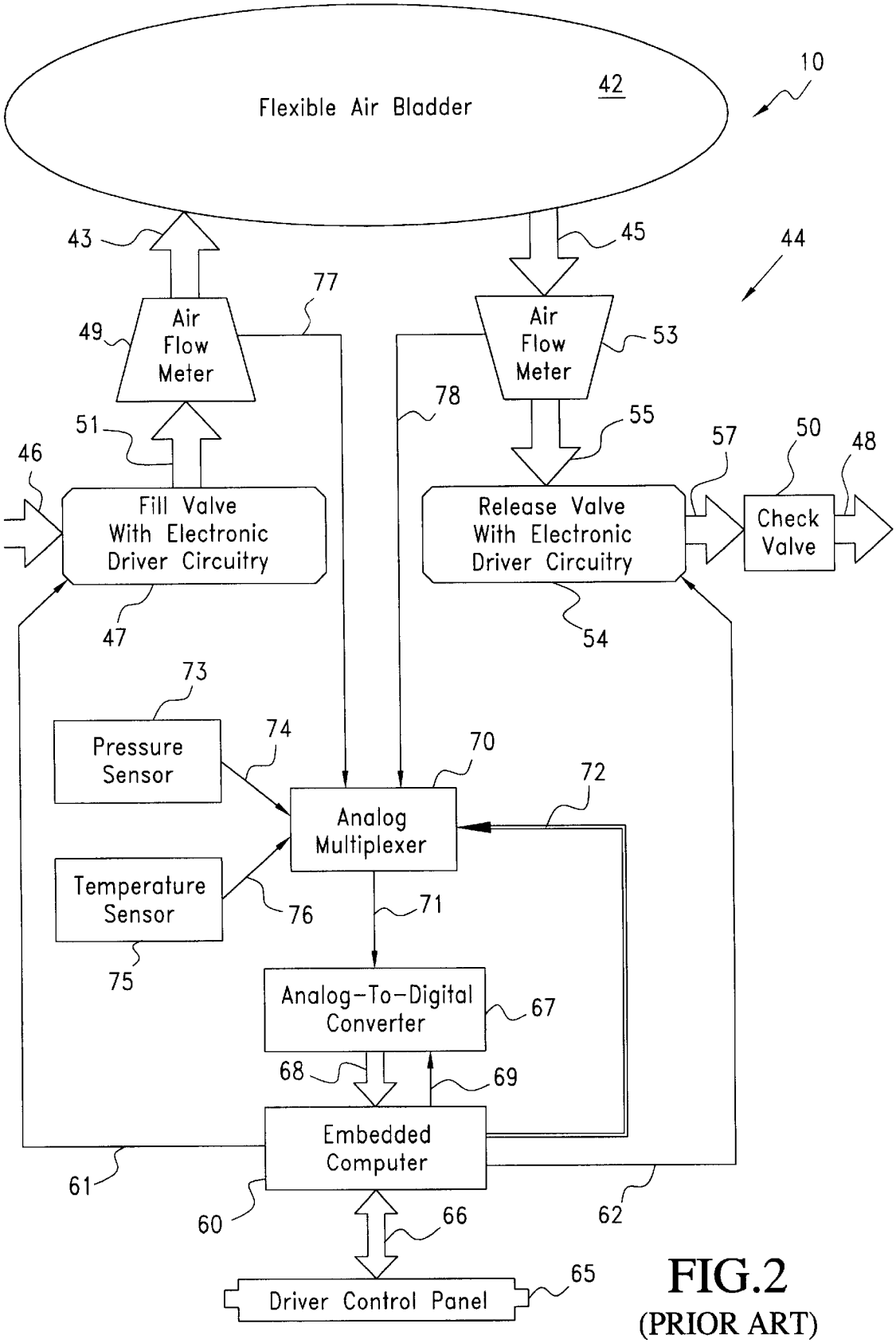
FIG.2 (PRIOR ART)
FIG. 2 is a block diagram which illustrates the operation of a prior art device.

As shown in FIG. 2, a buoyancy compensator device 10 for providing automatic control over the vertical motion of a scuba diver includes a buoyancy compensator bladder 42 and a subassembly 44 which are coupled together to provide fluid communication as indicated by arrows 43 and 45.

The bladder 42 is flexible so that when air is added to the bladder 42 through a coupling as indicated by arrow 43, the volume of water displaced increases. Also, when air is released from the bladder 42 as indicated by arrow 45, the volume of water displacement decreases. The bladder 42 compresses and expands with changes in the hydrostatic pressure of the surrounding water.

The subassembly 44 is coupled to regulator 18 (see FIG. 1) in a conventional manner to provide fluid communication between the source of pressurized air 16 (FIG. 1) as indicated by arrow 46. The assembly 44 is also coupled to a vent passage (not shown) as indicated by arrow 48 for fluid communication with the surrounding water. A check valve 50 provides a discharge path for air out of the assembly 44 and into the vent passage. The check valve 50 also blocks the flow of water into the assembly 44.

The scuba tank regulator 18 (FIG. 1) is coupled to the assembly 44 at the input of a fill valve 47. Fill valve 47 is conventional and includes electronic driver circuitry so that the valve can be opened or closed based on an input digital signal. The fill valve 47 is normally closed when no electrical power is applied to it and is used to gate the flow of air into the buoyancy compensator 42 which is supplied from a conventional air supply 16 (See FIG. 1).

The output of the fill valve 47 is coupled to the input of a fill gas flowmeter 49 by a coupling 51 which provides fluid communication between the two components. Flowmeter 49 is any suitable meter that provides an analog electrical output signal that is directly related to the sensed gas flow rate. The gas output of flowmeter 49 is connected to flexible air bladder 42 by coupling 43 which provides fluid communication between flowmeter 49 and flexible air bladder 42. The flowmeter 49 senses the amount of air added to the bladder 42.

The flexible air bladder 42 is also in fluid communication with the input of a release gas flowmeter 53 of subassembly 44 by the coupling 45. The flowmeter 53 can be any suitable meter that provides an analog electrical output signal that is directly related to the sensed gas flow rate. The flowmeter 53 senses the amount of air released from the bladder 42.

The gas outlet of the flowmeter 53 is connected to an input release valve 54 by a coupling 55 which provides fluid communication between the two components. The release valve 54 may be of any suitable design that includes an electronic driver circuit such that the release valve 54 can be opened or closed based on the state of an input signal. The output of the release valve 54 is connected to the check valve 50 by means of a coupling 57 which provides fluid communication between the release valve 54 and check valve 50. The release valve 54 is used to gauge the flow of air from the bladder 42 into the surrounding water.

A computer 60 is part of the subassembly 44 and may be any suitable computer which has sufficient computing capacity and memory to implement the controls. The microprocessor 60 has digital output ports to provide digital output high/low voltage levels and digital inputs to receive digital input high/low voltage levels. The computer 60 is connected to fill valve 47 and release valve 54 by digital control lines 61 and 62 respectively. The high/low voltage state of the signal from the computer 60 on control line 61 dictates the open/close state of fill valve 47 while the high/low voltage state of a signal from the microprocessor 60 on control line 62 dictates the open/closed state of release valve 54.

A scuba diver can input information into the computer 60 by means of a diver's control panel 65 which is connected to the computer 60 by a digital bus represented by a double arrow 66. The panel 65 provides an interface to input pre-dive information as well as manual selection of the dive mode during a dive. The panel 65 may also display dive output status information for the dive from the computer 60 such as time elapsed, dive depth and vertical velocity.

Computer 60 is also connected to an analog-to-digital converter 67 via a digital bus represented by arrow 68. Converter 67 is any suitable 8 bit analog-to-digital converter. The conversion input signal to converter 67 is provided by computer 60 via a control line 69.

An analog input signal to converter 67 is provided by an analog multiplexer 70 via a signal line 71. Multiplexer 70 may be any conventional analog multiplexer that outputs one of four analog input signals to signal line 71. The signal to be output on signal 71 is based on the state of two digital input control lines provided by computer 60 and represented by a double line arrow 72.

One of the input signals to the multiplexer 70 is a signal provided by a pressure sensor 73 via signal line 74. Sensor 73 may be any suitable sensor with supporting circuitry, that provides an analog output voltage which is directly related to the hydrostatic pressure of the surrounding water. A second signal provided to multiplexer 70 is a signal provided by a temperature sensor 75 via a signal line 76. Sensor 75 may be any suitable sensor, with supporting circuitry, that provides an analog output voltage which is directly related to the temperature of the air within the bladder 42.

The remaining two signals provided to the multiplexer 70 are provided by flowmeters 49 and 53 via signal lines 77 and 78 respectively. The input signals on line 57 is an analog voltage from flowmeter 49 which is directly related to the amount of air flowing into the bladder 42. The input signal on signal line 58 is an analog voltage from flowmeter 53 which is directly related to the amount of air flowing out of the bladder 42 and into the surrounding water.

A power source for the above described buoyancy compensator device is a conventional battery pack (not shown). A conventional method for operating the afore-described device is set forth in the aforementioned U.S. Pat. No. 4,549,136 of Egan which is incorporated herein in its entirety by reference.

In essence, a preferred embodiment of the present invention includes the same essential elements as shown in FIGS. 1 and 2. However, the device in accordance with the presently preferred embodiment of the invention includes an added safety feature which will be described in connection with FIGS. 3 and 4.

Figure 3:
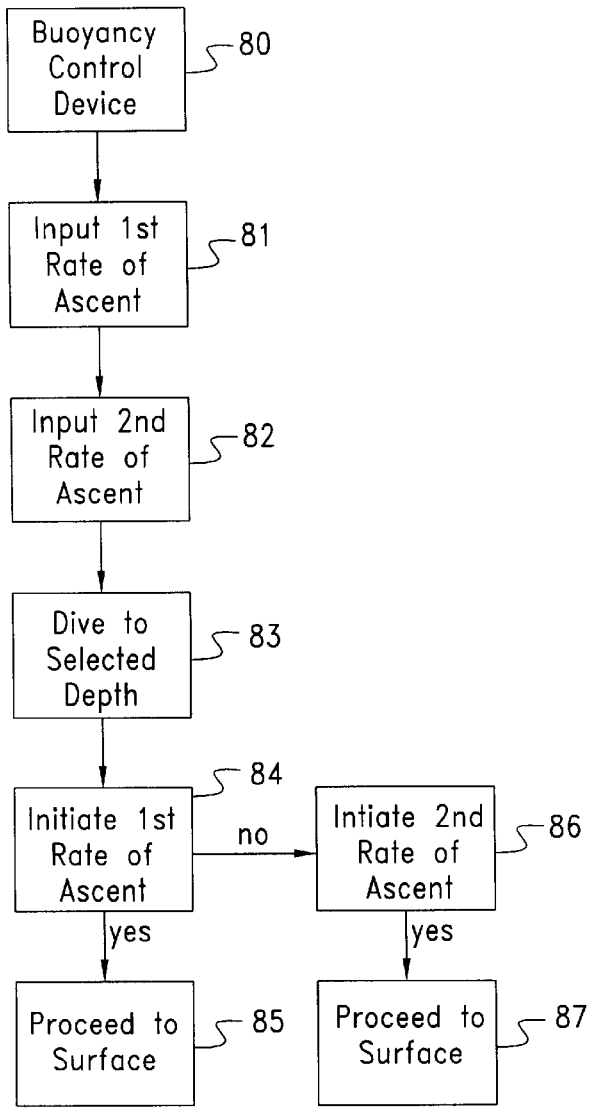
FIG. 3 is block diagram which illustrates the operation of a device in accordance with the present invention.
Figure 4:
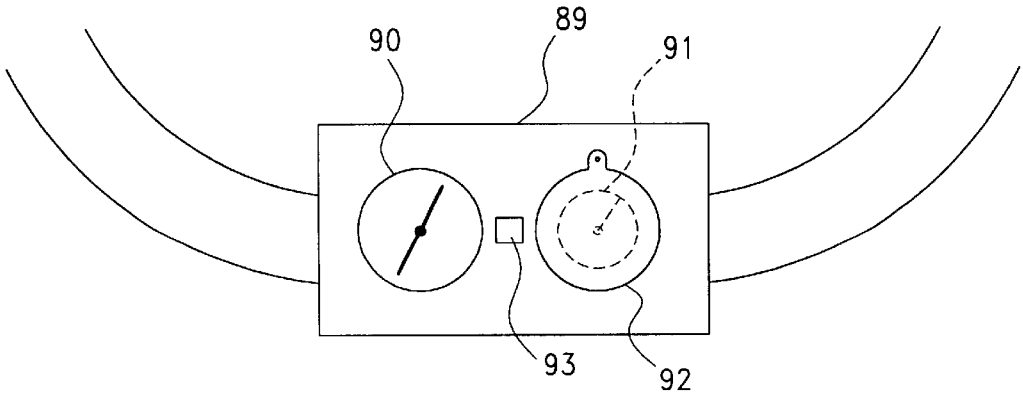
FIG. 4 is a schematic illustration of a control panel for use in a device in accordance with the present invention.

As illustrated in FIG. 3, a buoyancy control device 80 will typically include a flexible bladder, a compressed air tank, a depth gauge, a microprocessor for controlling the amount of air in the flexible bladder. It will also include computer input means 81 for inputting a first selected rate of ascent for controlling the vertical movement of a diver under normal conditions. For example, a diver can enter a preselected depth and a preferred rate of ascent including stops as for example a vertical ascent of about 10 ft. per minute with our without stops. A diver may for example program a stop of several minutes at about 14 ft. below the surface as commonly used.

The buoyancy control device 80 also includes input means 82 for inputting a second rate of ascent for use under emergency conditions. The second input means 82 may utilize the first input means 81 such as a rate selection switch to program a rate of vertical movement into a computer plus means for bypassing the first selected rate of ascent.

After selecting a first and second rate of ascent, a diver swims to a preselected depth as indicated in box 83 and uses the buoyancy compensator for neutral buoyancy at that depth. The diver may also adjust the buoyancy in a conventional manner to maintain a given depth, descend or ascend under manual control. The diver may choose to return to the surface under manual control or choose to return to the surface by initiating a first rate of ascent 84 for automatic control of their vertical movement. In those cases, the diver will be returned to the surface as indicated by the box 85 in a controlled manner.

However, when a diver fails to initiate action to return to the surface as for example due to an inability to take such action, it may be necessary for a second diver to come to the aid of the impaired diver. In such cases, it may be desirable to return the impaired diver to the surface at a slightly higher rate as for example, 15 ft. per minute for medical attention, but at the same time avoiding serious problems due to too rapid decompression.

The second diver may elect to initiate the second selected rate of ascent as indicated by box 86 and send the impaired diver to the surface automatically and unescorted as indicated by box 87.

The buoyancy during a dive may be maintained in a conventional manner using a conventional control panel. However, a control panel 89 in accordance with the present invention includes means for initiating a first rate of ascent as indicated by a switch 90 in FIG. 4. The device may also include means such as a recessed and covered button 91 for bypassing the first selected rate of ascent and automatically sending an unaccompanied or impaired diver to the surface without the necessity of escorting the impaired diver. A cover 92 prevents any inadvertent use of the second rate of ascent. The control panel 89 must also include variable means 93 for varying the rate of ascent under emergency conditions and/or to select a programmed step at preselected depths or for preselected times.

The buoyancy control device in accordance with the present invention is generally controlled by conventional techniques such as a switchable computer program which is well within the skill of a person of ordinary skill in the art.

While the invention has been described in connection with its preferred embodiments, it should be recognized that changes and modifications can be made therein without departing from the scope of the appended claims.

What is claimed is:

1. A buoyancy control device for scuba divers comprising:

a flexible buoyancy compensator adapted to be attached to a diver;

a compressed air tank adapted to be carried by the diver;

means for measuring the depth of the diver;

valve means connected to said buoyancy compensator and said compressed air tank for releasing air out of said compressed air tank and into said buoyancy compensator and for releasing air out of said buoyancy compensator and into the surrounding water;

a computer operatively connected to said means for measuring the depth of the diver and to said valve means for controlling the amount of air in said buoyancy compensator in response to the depth of the diver;

means for inputting a first selected rate of ascent for controlling the vertical movement of the diver under normal conditions and a second selected rate of ascent for controlling the vertical movement of the diver under emergency conditions; and means accessible by a second diver for overriding said first selected rate of ascent and activating said second rate of ascent; whereby a disabled diver can be safely sent to the surface without escort by the second diver at a rate which is greater than normal but at a faster rate of ascent under emergency conditions.

2. A buoyancy control device according to claim 1 which includes variable means for selecting a second rate of ascent which is preferred for existing conditions.

3. A buoyancy control device according to claim 1 which includes timing means and means for interrupting the ascent of the diver for selected intervals of time in order to avoid decompression sickness.

4. A buoyancy control device according to claim 1 which includes means for interrupting the ascent of a diver at a preselected depth for a preselected time to avoid decompression sickness.

5. A buoyancy control device according to claim 1 in which said means for inputting a first rate of ascent and said means for inputting a second rate of ascent are physically separated from one another.

6. A buoyancy control device according to claim 5 which includes means to prevent an inadvertent activation of said means for inputting a second rate of ascent.

7. A method for controlling the ascent of a submerged scuba diver comprising the steps of:

providing a buoyancy compensator having a flexible bladder, a compressed air tank, a depth gauge and a computer for controlling the amount of air in the flexible bladder;

inputting a first selected rate of ascent into the computer for controlling the vertical movement of the diver under normal conditions;

inputting a second selected rate of ascent into the computer for controlling the vertical movement of the under emergency conditions;

descending to a depth below the surface of the water;

initiating the first or the second rate of ascent to automatically control the vertical movement of the diver between the depth below the surface and the surface of the water.

8. The method for controlling the ascent of a submerged scuba diver according to claim 7 which includes the step of bypassing the first selected rate of ascent and activating a second selected rate of ascent to automatically control the return of the diver to the surface under the emergency conditions.

* * * * *